United States Patent [19]

Inagaki et al.

[11] Patent Number: 4,761,125

[45] Date of Patent: Aug. 2, 1988

[54] TWIN-SHAFT MULTI-LOBED TYPE HYDRAULIC DEVICE

[75] Inventors: Mitsuo Inagaki, Okazaki; Shigeki Iwanami, Nishio; Hideaki Sasaya; Hiromichi Nakano, both of Okazaki, all of Japan

[73] Assignee: Nippon Soken, Inc., Nishio, Japan

[21] Appl. No.: 30,058

[22] Filed: Mar. 25, 1987

[30] Foreign Application Priority Data

Mar. 29, 1986 [JP] Japan ..... 61-69769
Feb. 6, 1987 [JP] Japan ..... 62-24833

[51] Int. Cl.[4] ..... F04C 18/16
[52] U.S. Cl. ..... 418/201; 418/206
[58] Field of Search ..... 418/201-206

[56] References Cited

U.S. PATENT DOCUMENTS

| | | | |
|---|---|---|---|
| 572,946 | 12/1896 | Backstrom | 418/202 |
| 612,304 | 10/1898 | Blazer | 418/201 |
| 1,247,552 | 11/1917 | Lindenberg | 418/202 |
| 2,504,230 | 4/1950 | Smith | 418/203 |
| 2,670,188 | 2/1954 | Erdmenger | 418/201 |
| 3,734,653 | 5/1973 | Edstrom | 418/201 |
| 3,869,227 | 3/1975 | Kocher | 418/201 |
| 4,224,015 | 9/1980 | Nagata | 418/201 |
| 4,515,513 | 5/1985 | Hayase | 418/270 |
| 4,543,048 | 9/1985 | Densch | 418/201 |

FOREIGN PATENT DOCUMENTS

| | | | |
|---|---|---|---|
| 2934065 | 4/1980 | Fed. Rep. of Germany | 418/202 |
| 2944714 | 5/1981 | Fed. Rep. of Germany | 418/201 |
| 694484 | 12/1930 | France | 418/201 |
| 60-15387 | 3/1984 | Japan . | |
| 60-14945 | 5/1985 | Japan . | |

*Primary Examiner*—Leonard E. Smith
*Assistant Examiner*—Jane E. Obee
*Attorney, Agent, or Firm*—Cushman, Darby & Cushman

[57] ABSTRACT

A hydraulic device having a first shaft including a first rotor, and a second shaft including a second rotor, the first and second rotors being constructed by adjacently fitting the same shape rotor elements, respectively. The rotor elements have teeth on the outer periphery thereof at a constant interval, and each tooth has a tip portion fluid-tightly engaged with an inner wall of a housing of the device. The rotor elements are adjacently fitted to the shaft in such a manner that the rotor elements are displaced in the same rotational direction along the axial direction of the shaft. The teeth tip portions of the rotor elements adjacent to each other are overlapped so that spiral paths are defined on the outer surface of the rotor.

22 Claims, 8 Drawing Sheets

TWIN-SHAFT MULTI-LOBED TYPE HYDRAULIC DEVICE

BACKGROUND OF THE INVENTION

1. Field of the Invention

The present invention relates to a twin-shaft multi-lobed type hydraulic device, in particular, such a device used as a compressor for a vehicle air-conditioner or as an air pump.

2. Description of the Related Art

In the prior art, a Roots type compressor and a screw type compressor are well known as twin-shaft and multi-lobed type hydraulic devices. In the Roots type compressor, two mated lobed impellers define three working chambers within a casing; two of these chambers being defined by a combination of the two impellers and the casing, and the third chamber being defined by one impeller alone and the casing. Accordingly, during operation, the volume of the two chambers defined by the two impellers and the casing is reduced, but the volume of the third chamber defined by one impeller alone is not reduced, and therefore, the Roots type compressor cannot provide an effective compression during operation. Further, because there is communication between the chamber having a large volume and the chambers having a reduced volume, during the discharge process, the compressed fluid is slightly decompressed, allowing a fluid flow back to occur between the two chambers, and thus permitting the generation of undesirable noise and vibration. Therefore, a Roots type compressor can be used only for blowing and compression operations at a relatively low compression ratio. On the other hand, although a screw type compressor can provide a high compression ratio, any effective reduction of the size of the unit is limited because the teeth of the screw must be machined to a very high accuracy.

SUMMARY OF THE INVENTION

Therefore, an object of the present invention is provide a twin-shaft multi-lobed type hydraulic device by which a compression efficiency is improved, noise and vibration are reduced, and a high compression ratio is obtained.

According to the present invention, there is provided a twin-shaft multi-lobed type hydraulic device comprising a housing having a rotor chamber defined by an inner wall of the housing, a first shaft rotatably supported by the housing and connected to a drive source, a second shaft rotatably supported by the housing and operatively connected to the first shaft, a first rotor fixed to the first shaft, and a second rotor fixed to the second shaft. The housing also has an inlet and an outlet which are communicated with the rotor chamber. The first rotor has first rotor elements provided with teeth, each of which has an arc tip portion fluid-tightly engaged with the inner wall of the housing. These first rotor elements have substantially the same configuration and are adjacently fixed to the first shaft in such a manner that these first rotor elements are displaced in the same rotational direction along the axial direction of the first shaft and the tip portions of first rotor elements adjacent to each other are overlapped so that spaces between the teeth define a spiral path on the outer surface of the first rotor. The second rotor has second rotor elements provided with teeth, each of which has an arc tip portion fluid-tightly engaged with the inner wall of the housing. These second rotor elements have substantially the same configuration and are adjacently fixed to the second shaft in such a manner that these second rotor elements are displaced in the opposite rotational direction to that of the first rotor elements and the tip portions of the second rotor elements adjacent to each other are overlapped so that spaces between the teeth define a spiral path on the outer surface of the second rotor. The teeth of the second rotor elements are in mesh with the teeth of the first rotor elements, and the first and second rotors rotate synchronously to draw a fluid in through the inlet in the housing and into the rotor chamber and discharge the fluid through the outlet of the housing.

BRIEF DESCRIPTION OF THE DRAWINGS

The present invention may be more fully understood from the description of preferred embodiments thereof as set forth below, together with the accompanying drawings, in which.

DESCRIPTION OF THE PREFERRED EMBODIMENTS

The present invention will now be described with reference to drawings showing preferred embodiments thereof.

Figure 1:
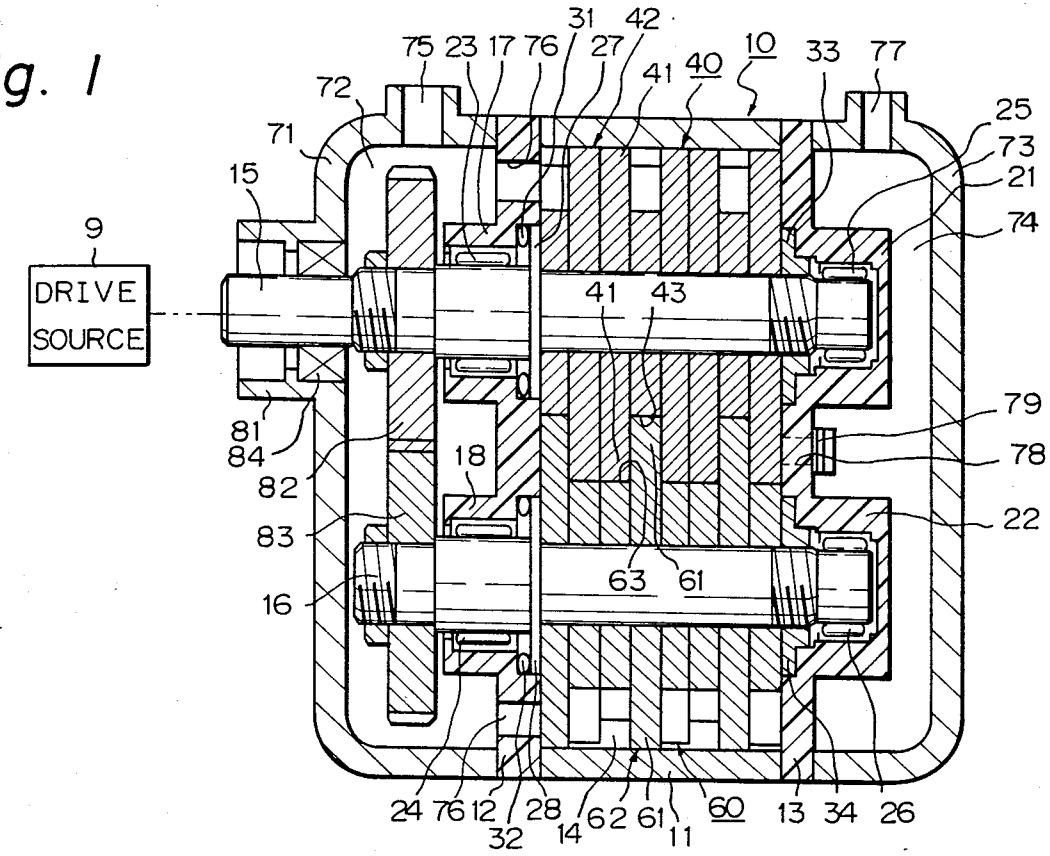
FIG. 1 is a sectional view of a first embodiment of the present invention.
Figure 3:
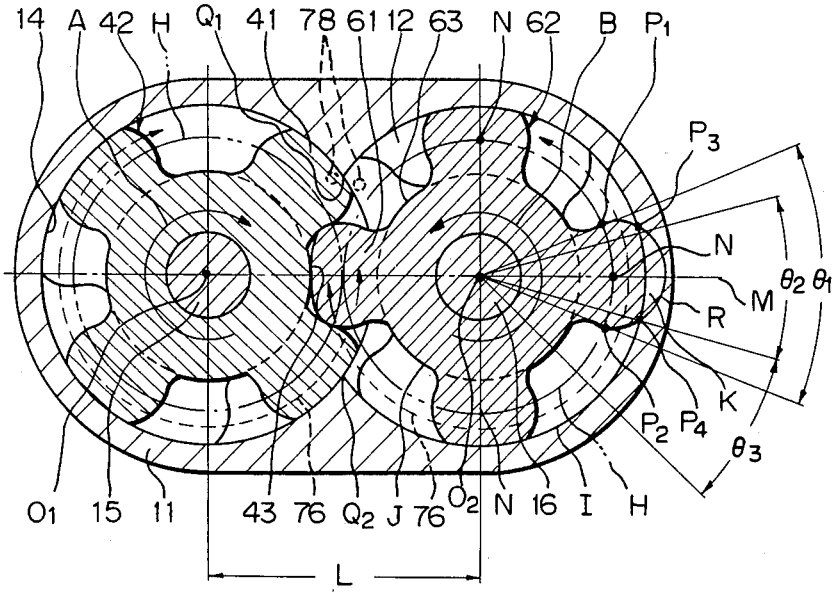
FIG. 3 is a transverse sectional view of the first and second rotors and the housing.

FIG. 1 shows a first embodiment of a twin-shaft multi-lobed type hydraulic device according to the present invention. In the Figure, a housing 10 has a cylindrical casing 11 having two openings, a front plate 12 being fitted to one opening and a rear plate 13 being fitted to the other opening so that a rotor chamber 14 is defined by an inner wall of the cylindrical casing 11. The rotor chamber 14 comprises two intersecting cylindrical chambers, as shown in FIG. 3. A driving shaft 15 and a driven shaft 16 are disposed in parallel in each chamber, respectively, and extend through the rotor chamber 14 to be rotatably supported by the front plate 12 and the rear plate 13. The front plate 12 has two outward projecting cylindrical bosses 17 and 18, and the rear plate 13 has two outward projecting cup-shaped bosses 21 and 22. Bearings 23, 24, 25, and 26 are provided in these bosses 17, 18, 21, and 22, so that the driving shaft 15 is rotatably supported by the bearings 23 and 25, and the driven shaft 16 is rotatably supported by the bearings 24 and 26. The driving and driven shafts 15 and 16 are provided with flanges 27 and 28, respectively, and a thrust bearing 31 is provided between the bearing 23 and the flange 27 of the driving shaft 15, and a thrust bearing 32 is provided between the bearing 24 and the flange 28 of the driven shaft 16.

A first rotor 40 and a second rotor 60 are fixed to the driving shaft 15 and the driven shaft 16, respectively, and are housed in the housing 10. As described later, these rotors 40 and 60 have teeth which are aligned in such a manner that gaps therebetween form a spiral path on the outer surface of the rotors 40 and 60, and the teeth of the rotor elements 42 and 62 are meshed to carry out a pump operation.

Figure 2:
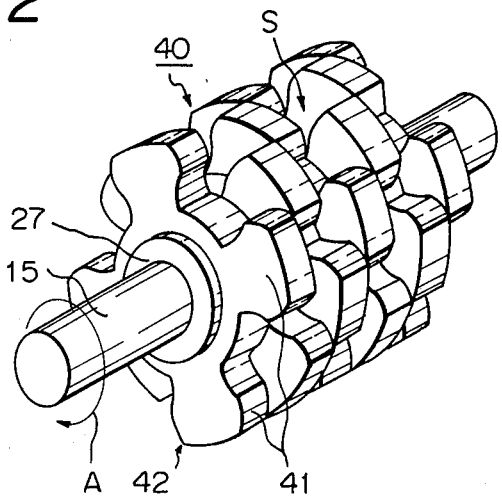
FIG. 2 is a perspective view of a first rotor provided in the device shown in FIG. 1.

FIG. 2 shows the construction of the first rotor 40. In this embodiment, the rotor 40 is constructed in such a manner that eight rotor elements 42 are adjacently fitted to each other along the axis of the driving shaft 15. The rotor elements 42 are provided with four teeth 41 along the outer periphery thereof, spaced at a constant interval and having substantially the same configuration. Each rotor element 42 is displaced by 30° from the adjacent rotor element 42, in the direction opposite to the rotating direction shown by an arrow A. The rotor elements 42 are fixed to the shaft 15 by a bolt 33 and the flange 27. Thus the teeth 41 are aligned in a spiral in such a manner that four spiral working chambers S are defined on the outer surface of the rotor 40 by the gaps between the spirally arranged teeth thereof. The second rotor 60 has a construction similar to the first rotor 40 fixed to the driving shaft 15, but the rotor elements 62 are displaced by 30° in the opposite direction to the displacement of the rotor elements 42 of the rotor 40, and are fixed to the driven shaft 16 by a bolt 34 and the flange 28 (FIG. 1). The teeth of the first and second rotor elements 42 and 62 are in constant mesh, and rotate in the arrowed A or B directions, respectively, as shown in FIG. 3. The outer surfaces of the first and second rotors 40 and 60 face the inner wall of the rotor chamber 14 with a very small clearance, so that the operation chambers S are substantially air-tightly isolated from each other.

That is, as shown in FIGS. 1 and 3, the teeth 41 and 61 of the rotors 40 and 60 face the inner wall of the rotor chamber 40 in an air-tight manner, and in an engaged portion of the rotors 40 and 60, a tooth 41 of the rotor 40 meshes with a recess 63 formed between two teeth 61 of the rotor 60 while a tooth 61 of the rotor 60 meshes with a recess 43 formed between two teeth 41 of the rotor 40. As shown in FIGS. 1 and 2, the teeth 41 of the rotor elements 42 are arranged in such a manner that the teeth 41 of every other rotor element 42 are at the same angular position, and similarly, the teeth 61 of the rotors element 62 are at the same angular position as the teeth 61 of every other rotor element 62.

As shown in FIG. 1, a front casing 71 is attached to the front plate 12 and an inlet chamber 72 is defined between the front casing 71 and the front plate 12. A rear casing 73 is attached to the rear plate 13 and an outlet chamber 74 is defined between the rear casing 73 and the rear plate 13. The front casing 71 is provided with an inlet port 75, and the front plate 12 is provided with an inlet 76, which connect the inlet chamber 72 to the operation chambers S of the rotor chamber 14. On the other hand, the rear casing 73 is provided with an outlet port 77, and the rear plate 13 is provided with an outlet 78 which connects the outlet chamber 74 to the operation chambers S of the rotor chamber 14. Thus, the inlet 76 is positioned circumferentially around the driving and driven shafts 15 and 16, and the outlet 78 is positioned between the shafts 15 and 16. The outlet 78 is opened and closed by a valve 79 fitted thereto. Namely, as shown in FIG. 3, the inlet 76 is formed over the portion shown by the broken line arrow, i.e., along the inner wall of the rotor chamber 14 to enclose the shafts 15 and 16, and the outlet 78 is provided at the portion whereat the teeth of the first and second rotors 40 and 60 begin to mesh. As described later, when the rotors 40 and 60 rotate in the arrowed A and B directions (FIG. 3), respectively, air in the inlet chamber 72 is drawn into the operation chambers S through the inlet 76, and is compressed to be discharged into the outlet chamber 74 through the outlet 78.

The driving shaft 15 extends through the boss 17 of the front plate 12 and penetrates the inlet chamber 72 to project from the boss 81 of the front casing 71. The boss 81 is provided with a seal member 84 to prevent air leakage from the inlet chamber 72. On the other hand, the driven shaft 16 extends through the boss 18 of the front plate 12 to a point close to an inner surface of the front casing 71. Helical gears 82 and 83 are housed in the inlet chamber 72 and fitted on the driving and driven shafts 15 and 16, respectively, and are in constant mesh. The tip portion of the driving shaft 15, which protrudes from the boss 81, is provided with a pulley (not shown), which is connected to a drive source 9 such as a crankshaft of an engine (not shown) by an endless belt and the like. Therefore, when the engine is driven, the driving shaft 15 is driven by the crankshaft, and through the helical gears 82 and 83, drives the shaft 16 so that the rotors 40 and 60 rotate synchronously.

The cylindrical casing 11, the front plate 12, the rear plate 13, the front casing 71, and the rear casing 73 are integrally joined by a bolt (not shown).

The construction of the rotor element 42 is described below with reference to FIG. 3.

In this embodiment, the rotor elements 42 of the driving shaft 40 and the rotor element 62 of the driven shaft 60 have the same configuration, and have four lobed teeth. The shape of one tooth is defined as follows.

First, base circles H are drawn about centers $O_1$ and $O_2$, which represent the axes of the driving and driven shafts 15 and 16, respectively, the diameters of the base circles H being the distance L between the centers $O_1$ and $O_2$. The base circle H is equally divided into four arcs so that four points N are defined. Two straight lines passing through the center $O_2$ and making an angle $\theta_1=45°$ are drawn in such a manner that a straight line M passing through a line between the points N at the center $O_2$ is positioned centrally between the two straight lines. Then, points $P_1$ and $P_2$ are obtained by intersecting the two straight lines with the base circle H. An arc R is drawn outside the base circle H, the arc R being a part of a circle which passes through the points $P_1$ and $P_2$, and which is centered at the point N. Two straight lines passing through the center $O_2$ and making an angle $\theta_2=30°$ are drawn in such a manner that the straight line M is positioned centrally between the two straight lines. Then, points $P_3$ and $P_4$ are obtained by intersecting the two straight lines with the arc R. An outer circle I passing through the points $P_3$ and $P_4$ and having the center $O_2$ is drawn, and the arc R is deleted at the part which extends outside of the outer circle I, whereby the portion enclosed by the curved line passing through the points $P_1$, $P_3$, $P_4$, and $P_2$ forms the outer part of the tooth, the outer part being positioned outside the base circle H.

The outer circle I substantially corresponds with the inner wall of the rotor chamber 14, and the arc part formed between the points $P_3$ and $P_4$ of the outer circle I is a large arc portion K which faces the inner wall of the rotor chamber 14 with a very small clearance. On the other hand, the tooth inside part positioned inside the base circle H is comprised by an envelop line of the tooth outside part positioned outside the base circle H, the envelop line being formed when a tooth 41 of the driving shaft 15 and a tooth 61 of the driven shaft 16 are meshed and rotated in opposite directions at the same rotation speed. At this time, a small arc portion J is formed between two adjacent teeth.

The rotor elements 42 and 62 constructed as described above are adjacently fitted to a shaft in such a manner that the angular position of each two adjacent elements is displaced in the same direction by an angle $\theta_3=30°$, as already described, so that the driving rotor 40 and the driven rotor 60 are constructed. Namely, in this embodiment, the angle $\theta_2$ of the large arc portion K and the offset angle $\theta_3$ are the same, i.e., 30°.

The diameters of the pitch circles of the helical gears 82 and 83 are the same as the base circle H.

The device of this embodiment operates as follows.

When the driving shaft 15 is rotated by the application of power from the drive source 9, such as an engine crankshaft, the drive shaft 15 and the driven shaft 16 are rotated in opposite directions by the helical gears 82 and 83. Accordingly, the rotors 40 and 60 mate and rotate in opposite directions. Now, as shown in FIG. 3, when the rotor elements 42 and 62 are meshed, the outer surfaces of the teeth 41 and 61 engage with the inner wall of the rotor chamber 14 in an air-tight manner, and at the meshed portion, the teeth 41 and 61 are in air-tight contact at one point at least. Therefore, the operation chambers S (FIG. 1) defined by the teeth 41 and 61 are air-tightly isolated from each other, so that when the rotors 40 and 60 rotate synchronously, on one hand the volume of the chambers S is expanded to draw air through the inlet 76 into the chambers S, and on the other hand, the volume of the chambers S is reduced to discharge the air through the outlet 78.

A pumping operation of this embodiment is described with reference to FIGS. 4 and 5. In the drawings, the rotors 40 and 60 are drawn on one plane, and the white squares on the left denote the teeth 41 of the driving rotor 40, and the hatched squares on the right denote the teeth 61 of the driven rotor 60. Further, in the drawings, symbols $Q_1$ and $Q_2$ correspond to the intersecting points $O_1$ and $O_2$ of the two circles which define the cross-section of the inner wall of the rotor chamber 14 (FIG. 3). Zones $Z_1$ and $Z_2$ defined between $Q_1$ and $Q_2$ correspond to the inner wall of the rotor chamber 14. The large arc portions K (FIG. 3) of the teeth 41 and 61 are in fluid-tight engagement with the inner wall in the zones $Z_1$ and $Z_2$. In the other zones, the teeth 41 and 61 are meshed in a fluid-tight manner. Each tooth 41 and 61 is in fluid-tight mesh with the corresponding tooth of the adjacent rotor element. Namely, the angle $\theta_2$ of the large arc portion K of one tooth is equal to or larger than the offset angle $\theta_3$ which is defined by angular displacement of two teeth of two adjacent rotor elements, or the large arc portions K adjacent to each other are overlapped, so that the two teeth are in fluid-tight contact. Thus, the operation chambers S defined on the outer surface of the rotors 40 and 60 are fluid-tightly isolated from each other.

The working chambers of the driving rotor 40 are denoted as $S_{11}$, $S_{12}$, $S_{13}$, $S_{14}$, $S_{15}$, and $S_{16}$, from left to right in the drawing, and the working chambers of the driven rotor 60 are denoted as $S_{21}$, $S_{22}$, $S_{23}$, $S_{24}$, $S_{25}$, and $S_{26}$ from right to left in the drawing. In the state shown in FIG. 4, the chambers $S_{15}$ and $S_{25}$ are communicated, and the chambers $S_{16}$ and $S_{26}$ are communicated. If the rotors 40 and 60 rotate in the arrowed A and B directions, respectively, the volume of the working chamber $S_{12}$ is increased so that air is drawn into the chamber $S_{12}$ through the inlet 76, and the volume of the working chambers $S_{16}$ and $S_{26}$ is decreased so that air therein is discharged through the outlet 78, for example.

Figure 4:
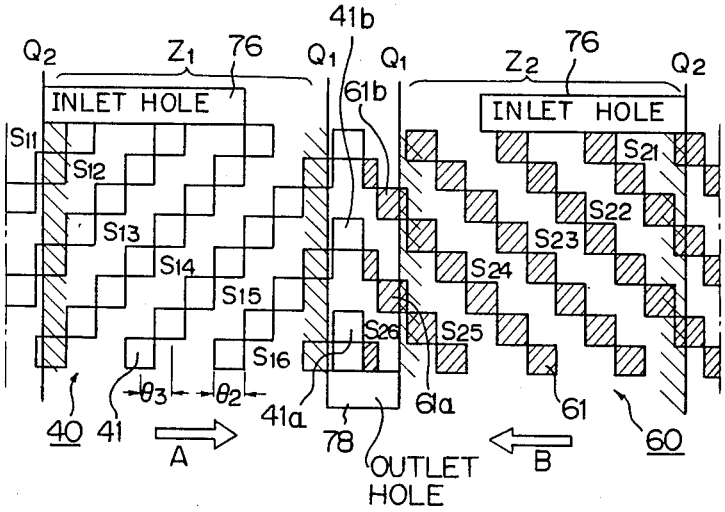
FIG. 4 is a view of the alignment of the teeth of the rotors, drawn in one plane.
Figure 5:
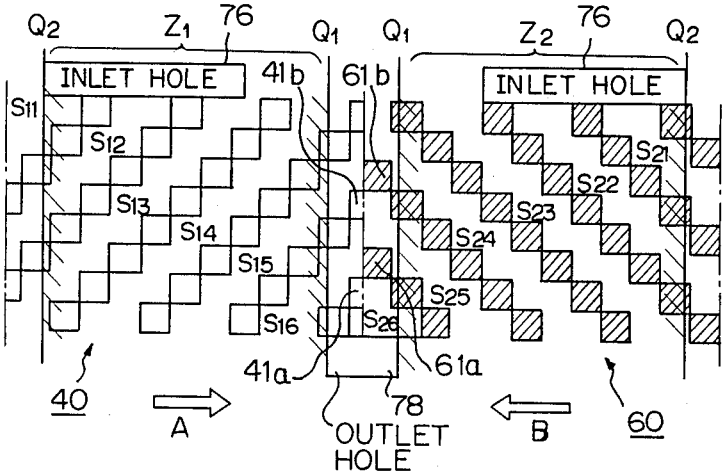
FIG. 5 is a view of the alignment of the teeth of the rotors when the rotor has rotated by distance of a half breadth of the teeth, drawn in one plane.

In this process, if the rotors 40 and 60 are rotated by a half of the length of the large arc portion K of the tooth, from the state shown in FIG. 4, the positions of the rotors 40 and 60 are changed to the state shown in FIG. 5. Namely, the tooth 61*a* of the driven rotor 60 which is located rear $Q_1$ and at the third position from the bottom of the drawing is apart from $Q_1$, to come into contact with the tooth 41*a* of the driving rotor 40 which is located rear $Q_1$ and at the second position from the bottom of the drawing. Similarly, the tooth 61*b* of the driven rotor 60 which is located rear $Q_1$, and at the sixth position from the bottom apart from $Q_1$, to come into contact with the tooth 41*b* of the driving rotor 40 which is located rear $Q_1$ and at the fifth position from the bottom. Thus, although the working chamber $S_{16}$ is communicated with the working chamber $S_{26}$ in the state shown in FIG. 4, the working chamber $S_{16}$ is isolated from the working chamber $S_{26}$ to communicate with the working chamber $S_{25}$ having a relatively slightly low pressure in the state shown in FIG. 5. Therefore, although the pressure in the working chamber $S_{16}$ is slightly reduced for a time, the pressure is soon raised. Thus, air in the working chamber is compressed and then discharged from the outlet 78.

As described above, in the construction of this embodiment the rotors 40 and 60 are constructed in such a manner that the eight rotor elements 41 and 61 having four teeth are adjacently fitted and displaced by 30° in the rotational directions. Namely, the rotors 40 and 60 have a substantially screw shape. Therefore, a high compression efficiency can be obtained when the device is used as an air pump having a relatively high compression ratio. Since the working chambers are separately defined on the outer surfaces of the rotors 40 and 60, only a relatively low pressure difference exists between two adjacent working chambers. Therefore, when air in one working chamber is released to another operation chamber having a relatively low pressure, during a compression process, the pressure reduction in the former chamber is small, so that noise and vibration are restrained. Further, since the rotors 40 and 60 of this embodiment are constructed in such a manner that the rotor elements 42 and 62 having a simple, same configuration are fitted adjacently, a complicated and precise manufacturing process, as for a conventional screw type compressor, is not needed. Namely, the embodied device is easily made, and easily reduced in size, and can obtain a high operating efficiency.

Since the hydraulic device according to the first embodiment can obtain a high compression ratio as described above, this device can be applied to a compressor for a refrigerant used for a vehicle air-conditioning device. When this hydraulic device is used as a refrigerant compressor, the device draws refrigerant from a vaporizer of a cooling cycle, and compresses the refrigerant before discharging it to a condenser. In the cooling cycle, since a lubricant is included in the refrigerant, the sealing of the hydraulic device is properly maintained by the lubricant during a compression process.

Figure 6:
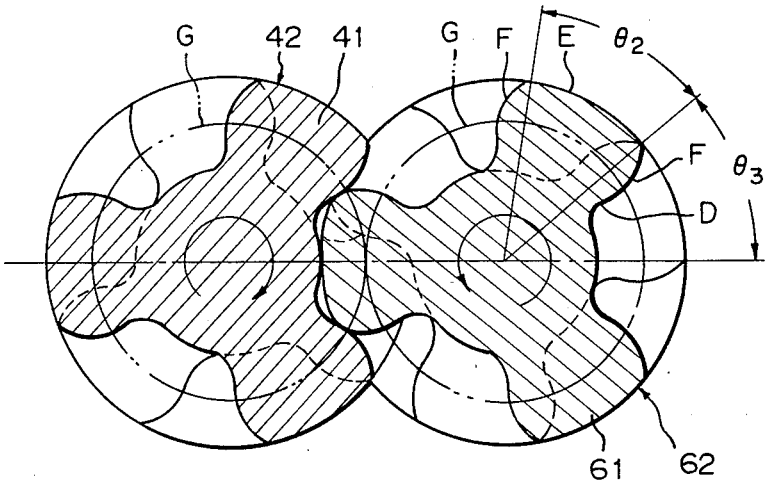
FIG. 6 is a sectional view of the first and second rotors of a second embodiment of the present invention.

FIG. 6 shows rotor elements 42 and 62 of a second embodiment of the present invention. In this embodiment, each of the rotor elements 42 and 62 have three teeth 41 and 61, respectively. The teeth 41 and 61 are shaped such that outer parts of a base circle G are composed of flank portions F having cycloid curves and a large arc portion E which has the same sectional shape as the inner wall of the rotor chamber and extends within an angle $\theta_2=40°$ about the center of the rotor. Inner parts D of the base circle G have an envelop shape formed by rotation of the outer contour of the corresponding meshed teeth. There are six rotor elements 42 and 62 adjacently fitted along the axial direction, and the offset angle $\theta_3$ between the two adjacent rotor elements is 40°. Namely, the angle $\theta_2$ of the large arc portion E is the same as the offset angle $\theta_3$. In this embodiment, the teeth 41 and 61 of every third rotor elements 42 and 62 are arranged at the same angular position.

Note that the number of teeth of one rotor element is not restricted to three or four, and the number of adjacently fitted rotor elements is not restricted to six or eight. Although it is not necessary for the thickness of each rotor element to be the same, the thickness of mating rotor elements must coincide. Rotors having such a construction will be described later. The angle $\theta_2$ of the large arc portion of a tooth is not restricted to 30° or 40°, and the offset angle $\theta_3$ is not restricted to 30° or 40°. Nevertheless, to prevent communication between adjacent working chambers, the angle $\theta_2$ must be equal to or larger than the offset angle $\theta_3$. In other words, the two large arc portions of the adjacent rotor elements must overlap. Further, it is not necessary to angularly offset each adjacent rotor element in such a manner that the teeth of every other rotor element are arranged at the same angular position. For example, when the hydraulic device of the present invention is applied to an engine super charger used under a relatively low compression ratio, the angle $\theta_2$ of the large arc portion E and the offset angle $\theta_3$ may have small values according to the purpose of use.

Further, in the above embodiments, the teeth 41 and 61 of the rotor elements 41 and 62 are angularly displaced in the reverse rotational direction, but the teeth 41 and 61 may be displaced in the rotational direction of the rotors. In this construction, the functions of the inlet and outlet must be reversed.

It is not necessary to operatively connect the driving shaft 15 to the driven shaft 16 through the helical gears 82 and 83, in that the driving and driven shafts 15 and 16 may be operatively connected to each other through the rotors 40 and 60 if the hydraulic device is used under a low load condition.

Figure 8:
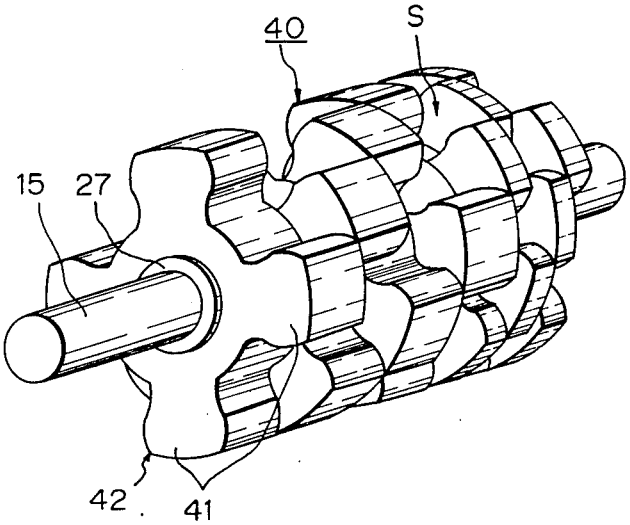
FIG. 8 is a perspective view of a first rotor provided in the device shown in FIG. 7.
Figure 7:
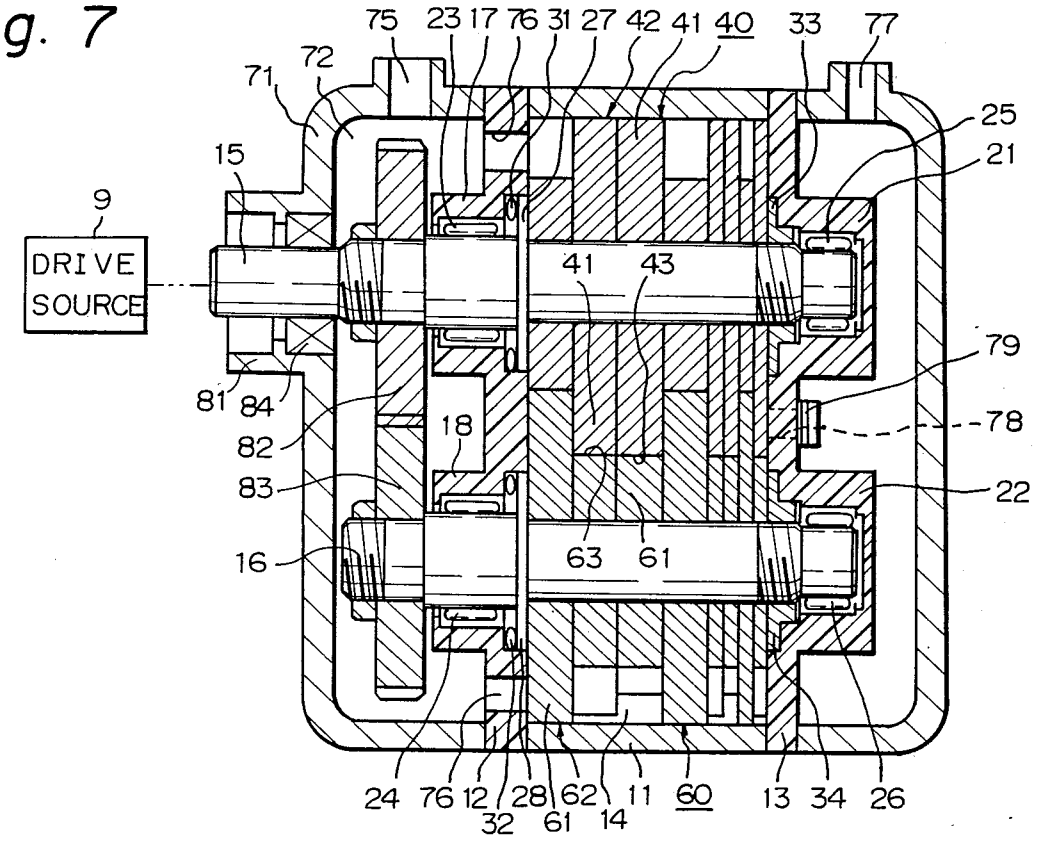
FIG. 7 is a sectional view of a third embodiment of the present invention.

FIG. 7 shows a hydraulic device of a third embodiment of the present invention. In this third embodiment, the rotor elements 42 have a different thickness, i.e., the axial widths of the four rotor elements 42 near the outlet 78 are relatively small compared to the axial widths of the rotor elements 42 positioned near the inlet 76. The rotor elements 62 have the same construction as the rotor elements 42. Namely, the mating rotor elements 42 and 62 have the same axial width. FIG. 8 generally shows the construction of the rotor 40. The remaining construction is the same as that of the first embodiment shown in FIGS. 1 through 3, and therefore, an explanation thereof is omitted.

Figure 9:
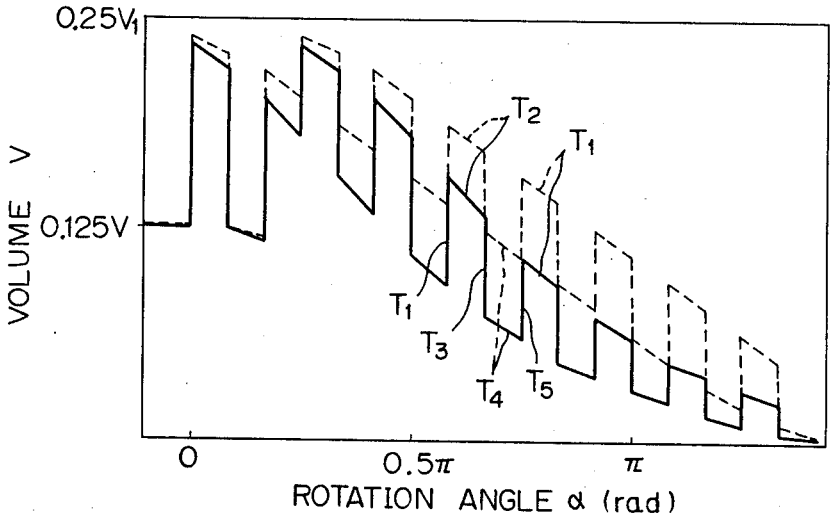
FIG. 9 is a graph showing the relationship between a rotational angle of the rotor shaft and a volume of the working chamber.
Figure 10:
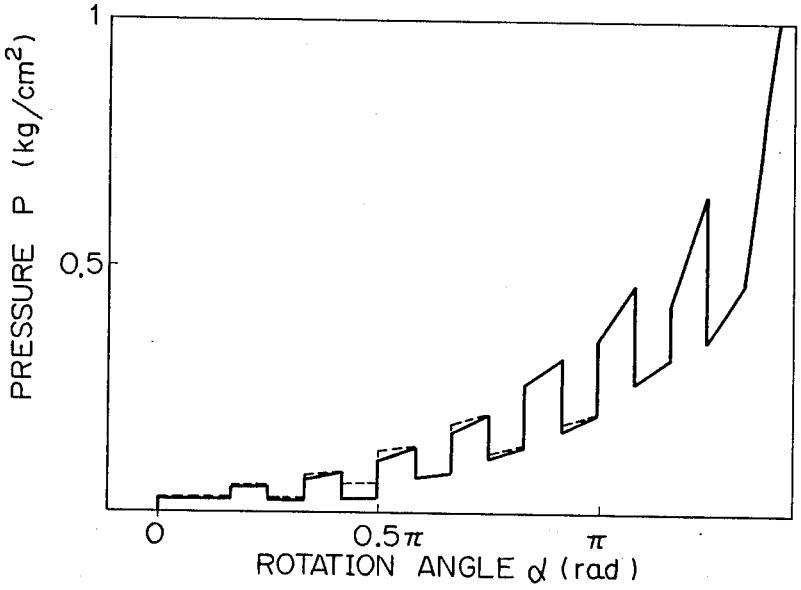
FIG. 10 is a graph showing the relationship between a rotational angle of the rotor shaft and a pressure in the working chamber.

FIGS. 9 and 10 show the operating characteristics of the first to third embodiments.

FIG. 9 shows a change of volume V of the working chamber S relative to a rotation angle $\alpha$ of the rotors 40 and 60. Supposing that the discharge volume of this hydraulic device is $V_1$, the maximum volume of the working chamber S of one rotor is 0.125 $V_1$. When two working chambers of the first and second rotors 40 and 60 are communicated, if the area formed by the two working chambers is regarded as one working chamber, the volume of the working chamber changes as shown in FIG. 9. In the working chamber $S_{15}$ in FIG. 4, for example, the working chamber $S_{15}$ has been communicated with the working chamber $S_{25}$ of the other rotor by the rotation of the rotors 40 and 60, so that the volume of the working chamber $(S_{15}+S_{25})$ is abruptly increased, as shown by the reference mark $T_1$. Then, as the rotors rotate further, the working chamber $(S_{15}+S_{25})$ is compressed to reduce the volume V thereof, as shown by the reference mark $T_2$. The rotors then rotate further, and the working chamber $S_{15}$ is isolated from the working chamber $S_{25}$ so that the volume is abruptly decreased, as shown by the reference mark $T_3$. Although the volume of the working chamber $S_{15}$ is reduced, as shown by the reference mark $T_4$, with the rotation of the rotors, the working chamber $S_{15}$ communicates with the working chamber $S_{24}$ which is located near the working chamber $S_{25}$, so that the volume of the working chamber $(S_{15}+S_{24})$ is again suddenly increased, as shown by the reference mark $T_5$. The volume of the working chamber $S_{24}$ at this time is, however, smaller than the volume of the working chamber $S_{25}$ when the working chambers $S_{15}$ and $S_{25}$ are communicated. Therefore, the volume of the working chamber $(S_{15}+S_{24})$ is, as shown by the reference mark $T_6$, smaller than the volume of the working chamber $(S_{15}+S_{25})$ shown by the reference mark $T_2$. Repeating this increase and decrease causes the volume of the working chamber as a whole to become smaller, so that the fluid is compressed.

In the first embodiment, since the thickness of all rotor elements 42 and 62 is uniform, as shown by the broken line in FIG. 9, the amplitude of the increase and decrease of the volume of the working chamber caused by the communication and isolation of two working chambers is uniform, in spite of the rotational angle of the rotors, and the volume of the working chamber decreases linearly as a whole. Conversely, in the case of the third embodiment, the four rotor elements 42 and 62 near the outlet 78 have a relatively small axial width. Therefore, as shown by the solid line in FIG. 9, the amplitude of the increase and decrease of the volume of the working chamber caused by communication and isolation of two working chambers is relatively large when the rotation angle of the rotor is large, i.e., when the working chamber is near the inlet 76, and the amplitude is reduced as the rotation angle of the rotor is increased, i.e., as the working chamber approaches the outlet 78. Therefore, the degree of change in the working chamber becomes smaller as the working chamber approaches the outlet 78.

FIG. 10 shows a change of the pressure P in the working chamber showing the pressure change shown in FIG. 9. This example is the case in which the hydraulic device is used as a vacuum pump. Although the pressure P is about 0 kg/cm$^2$ at the portion near to the inlet 76, the pressure P becomes large when approaching the outlet 78, becomes approximately atmospheric pressure at or near the outlet 78. The pressure of the first embodiment is shown by the broken line, and the pressure of the third embodiment is shown by the solid line. As understood from the drawing, although the pressure P in the working chamber of the third embodiment is smaller than that of the first embodiment, and the rotation angle of the rotors is relatively small, the rotation angle of the rotors becomes large when the working chamber approaches the outlet 78, so that the pressure in the first and third embodiments is almost the same.

The driving torque of the vacuum pump is determined by the product of the volume V of the working chamber and the pressure P. As understood from FIGS. 9 and 10, in the third embodiment, if the rotation angle of the rotor becomes larger, since the volume of the working chamber is considerably reduced compared to the volume of the working chamber of the first embodiment, the driving torque is considerably reduced. In particular, at the outlet 78, the volume of the working chamber of the third embodiment is reduced, so that the driving torque is reduced. According to calculations by the inventors, the driving torque of the third embodiment is reduced by 33% compared to that of the first embodiment. Further, according to the third embodiment, the volume change in the working chamber near the outlet is slight, so that is little fluid backflow, and thus the operating characteristic is improved.

Figure 11:
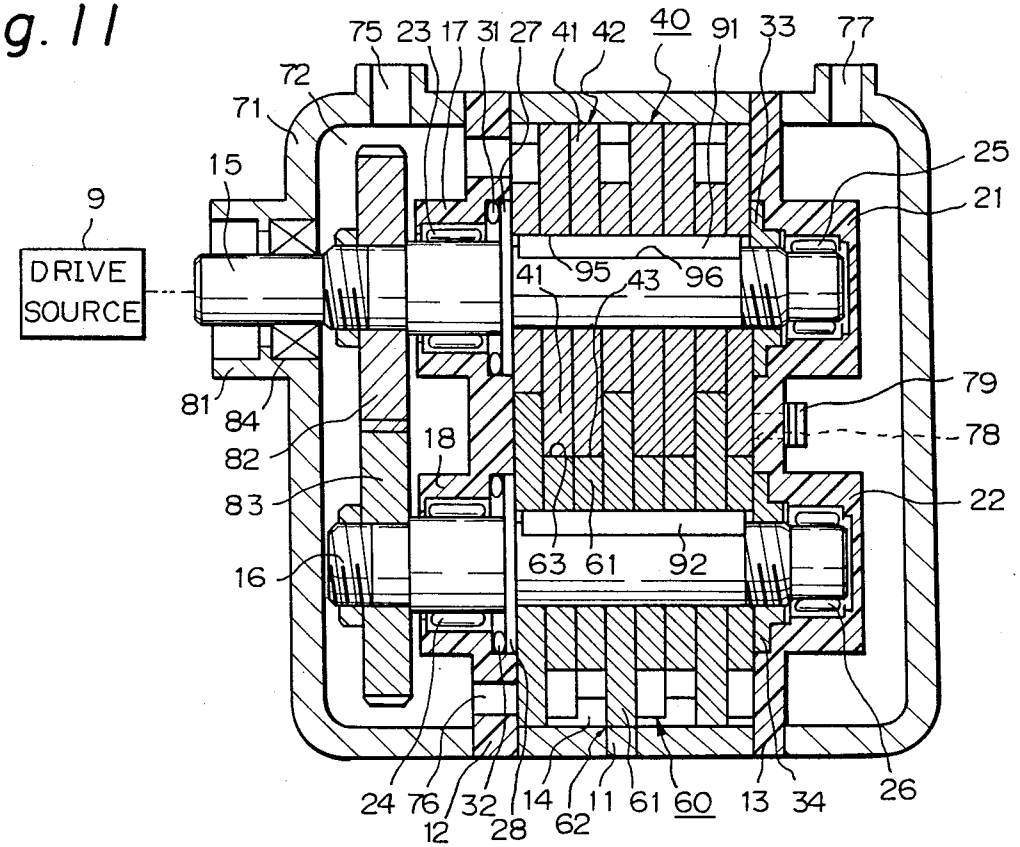
FIG. 11 is a sectional view of a fourth embodiment of the present invention.
Figure 12:
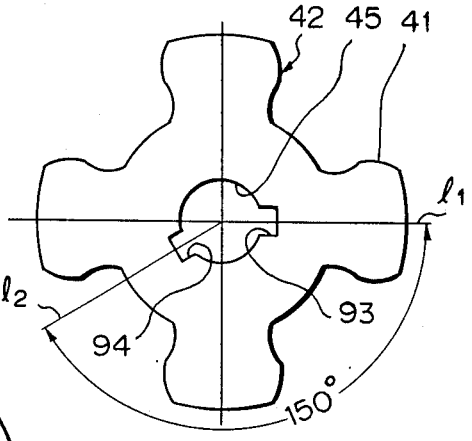
FIG. 12 is a front view of a first rotor element provided in the device shown in FIG. 11.
Figure 13:
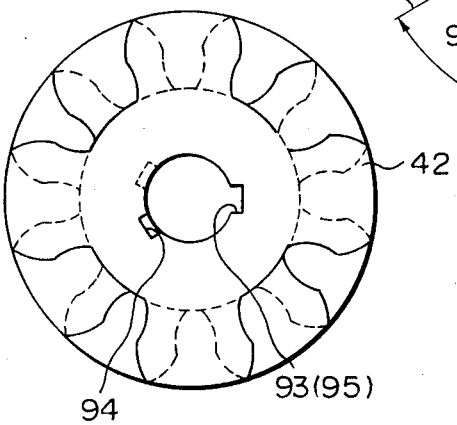
FIG. 13 is a front view of a first rotor formed by assembling the first rotor elements shown in FIG. 12.
Figure 14:
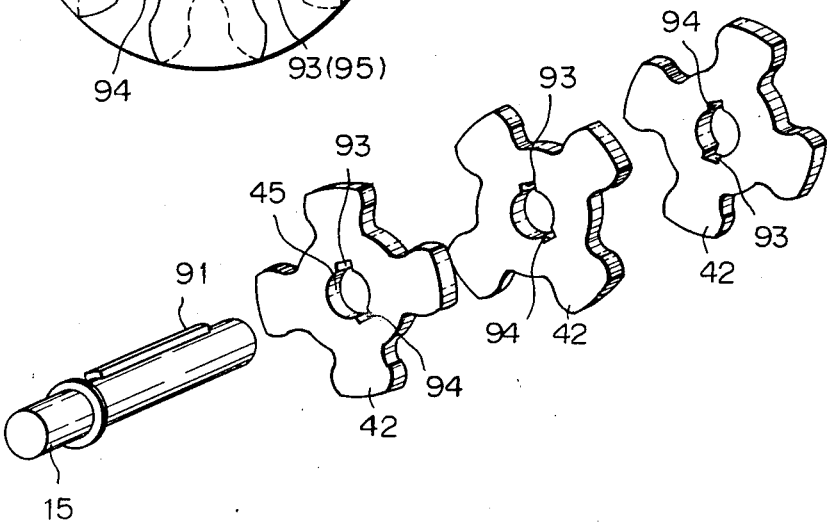
FIG. 14 is a perspective view of the first rotor provided in the device shown in FIG. 11, in a disassembled state.

FIG. 11 shows a hydraulic device of a fourth embodiment of the present invention. In this embodiment, each rotor element 42 of the rotor 40 is fixed in the rotational direction of the rotor 40 by a key 91 extending in the axial direction of the driving shaft 15, and similarly, each rotor element 62 of the rotor 60 is fixed in the rotational direction of the rotor 60 by a key 92 extending in the axial direction of the driven shaft 16. FIG. 12 shows a construction of the rotor element 42. Two notches 93 and 94 are formed in a opening 45 made in the center of the rotor element 42, and the driving shaft 15 is fitted therein. One notch 93 lies on a straight line $l_1$ extending right-left direction in the drawing, and the other notch 94 lies on a straight line $l_2$ which is obtained by a 150° clockwise rotation of the line $l_1$. In this embodiment, the rotor element 42 has four teeth 41, and another rotor element provided adjacent to the first rotor element 42 is displaced angularly by 30°. Therefore, as shown in FIG. 13, one of the notches 93 and 94 corresponds to a notch of the adjacent rotor element. Thus, as shown in FIG. 14, when these rotor elements are adjacently fitted to the driving shaft 15 at an angular displacement of 30°, at least one notch 93 or 94 of each rotor element is aligned in a straight line. That is, a key groove 95 (FIG. 13) extending along the axis of the driving shaft 15 is formed by one of the notches 93 and 94 of each rotor element 42, so that the key 91 can be inserted in the key groove 95. The inner portion of the key 91 is engaged with a key groove 96 (FIG. 11) formed in the driving shaft 15. The rotor 60 of the driven shaft 16 is also provided with a key 92.

Accordingly, there is no slippage of the rotor elements 42 and 62 relative to the driving shaft 15 and the driven shaft 16, so that the rotors 40 and 60 are in constant mesh. Since the two notches 93 and 94 are formed in the opening 45 of the rotor element, 150° apart, the notches of either of the rotor elements can be aligned on a straight line. Therefore, all the rotor elements can be made in the same shape, so that the manufacturing of the rotor elements and assembly of the elements to the rotor shafts 15 and 16 are very easy.

Although embodiments of the present invention have been described herein with reference to the attached drawings, many modifications and changes may be made by those skilled in this art without departing from the scope of the invention.

We claim:

1. A hydraulic device having two shafts and multilobed rotors mounted to each shaft, said rotors being rotated by a drive source applied to said shafts to compress fluid, said hydraulic device comprising:

a housing having a rotor chamber defined by an inner wall, and an inlet and an outlet, said inlet and outlet being in communication with said rotor chamber;

a first shaft rotatably supported by said housing and connected to said shaft source;

a second shaft rotatably supported by said housing and operatively connected to said first shaft;

a first rotor having first rotor elements provided with at least three teeth and less than five teeth formed on the outer periphery thereof at a constant integral, each of said teeth having an arc tip portion fluid-tightly engaged with said inner wall, first and second circumferential ends of each said arc tip defining therebetween and with the center of said respective rotor element an angle $\theta_2$, said first rotor elements having substantially the same configuration, and being adjacently fixed to said first shaft in such a manner that said first rotor elements are displaced by an angle $\theta_3$ in the same rotational direction along the axial length of said first shaft and said teeth tip portions of first rotor elements adjacent to each other are overlapped so that the spaces between said teeth define a spiral path on the outer surface of said first rotor, said angle $\theta_2$ being substantially equal to said offset angle $\theta_3$; and a second rotor having second rotor elements provided with at least three teeth and less than five teeth formed on the outer periphery thereof at a constant level, each of said teeth having an arc tip portion fluid-tightly engaged with said inner wall, first and second circumferential ends of each said arc tip defining therebetween and with the center of said respective rotor element an angle $\theta_2$, said second rotor elements having substantially the same configuration and being adjacently fixed to said second shaft in such a manner that said second rotor elements are displaced by an angle $\theta_3$ in the opposite direction to said first rotor elements and said teeth tip portions of second rotor elements adjacent to each other are overlapped so that spaces between said teeth define a spiral path on the outer surface of said second rotor, said teeth of said second rotor elements being in mesh with said teeth of said first rotor elements, said angle $\theta_2$ being substantially equal to said offset angle $\theta_3$;

said first and second rotors rotating synchronously to draw fluid in through said inlet into said rotor chamber and discharge said fluid out through said outlet.

2. A hydraulic device according to claim 1, wherein a part of flank portions of said teeth is formed in an arc shape.

3. A hydraulic device according to claim 1, wherein a part of flank portions of said teeth is formed in a cycloid shape.

4. A hydraulic device according to claim 1, wherein said first and second rotor elements are displaced in a rotational direction by 30° relative to adjacent rotor elements.

5. A hydraulic device according to claim 1, wherein said first and second rotor elements are displaced in a rotational direction by 40° relative to adjacent rotor elements.

6. A hydraulic device according to claim 1, wherein said first and second shafts have flanges and nuts, respectively, said first rotor elements being sandwiched by said flange and nut to be fixed to said first shaft, and said second rotor elements being sandwiched by said flange and nut to be fixed to said second shaft.

7. A hydraulic device according to claim 1, whrein said housing has a longitudinal axis substantially parallel to a longitudinal axis of said first shaft and substantially parallel to a longitudinal axis of said second shaft, said inlet and outlet being defined at opposite longitudinal ends of said housing, the first and second rotor elements disposed near the outlet having a relatively small axial width.

8. A hydraulic device according to claim 1, wherein said first and second shafts are provided with helical gears, respectively, which are meshed to rotate said first and second shafts synchronously.

9. A hydraulic device according to claim 1, wherein said housing comprises a cylindrical casing having said rotor chamber and two openings, a front plate being fitted to one of said openings and having said inlet, a front casing covering said front plate to define an inlet chamber with said front plate and having an inlet port, a rear plate being fitted to the other one of said openings and having said outlet, a rear casing covering said rear plate to define an outlet chamber with said rear plate and having an outlet port.

10. A hydraulic device according to claim 1, wherein said first and second shafts have keys extending along the axis of said shafts, respectively, to fix said first and second rotor elements to said first and second shafts.

11. A hydraulic device according to claim 10, wherein said first and second rotor elements are provided with center holes for inserting said first and second shafts therein, each of said center holes having two notches 150° apart, said first and second rotor elements being displaced in a predetermined rotational direction so that one notch of every rotor element coincides with the notch of an adjacent rotor element.

12. A hydraulic device having two shafts and multilobed rotors mounted to each shaft, said rotors being rotated by a drive source applied to said shafts to compress refrigerant of a vehicle air-conditioner, said hydraulic device comprising:

a housing having a rotor chamber defined by an inner wall, and an inlet and an outlet, said inlet and outlet being in communication with said rotor chamber;

a first shaft rotatably supported by said housing and connected to said drive source;

a second shaft rotatably supported by said housing and operatively connected to said first shaft;

a first rotor having elements provided with at least three teeth and less than five teeth formed on the outer periphery thereof at a constant integral, each of said teeth having an arc tip portion fluid-tightly engaged with said inner wall, first and second circumferential ends of each said arch tip defining therebetween and with the center of said respective rotor element an angle $\theta_2$, said first rotor elements having substantially the same configuration, and being adjacently fixed to said first shaft in such a manner that said first rotor elements are displaced by an angle $\theta_3$ in the same rotational direction along the axial direction of said first shaft and said teeth tip portions of first rotor elements adjacent to each other are overlapped so that the spaces between said teeth define a spiral path on the outer surface of said first rotor, said angle $\theta_2$ being substantially equal to said offset angle $\theta_3$; and a second rotor having second rotor elements provided with at least three teeth and less than five teeth formed on the outer periphery thereof at a constant interval, each of said teeth having an arc tip portion fluid-tightly engaged with said inner wall, first and second circumferential ends of each said arch tip defining therebetween and with the center of said respective rotor element an angle $\theta_2$, said second rotor elements having substantially the same configuration and being adjacently fixed to said second shaft in such a manner that said second rotor elements are displaced by an angle $\theta_3$ in the opposite direction to said first rotor elements and said teeth tip portions of second rotor elements adjacent to each other are overlapped so that spaces between said teeth define a spiral path on the outer surface of said second rotor, said teeth of said second rotor elements being in mesh with said teeth of said first rotor elements, said angle $\theta_2$ being substantially equal to said offset angle $\theta_3$;

said first and second rotors rotating synchronously to draw fluid in through said inlet into said rotor chamber and discharge said fluid out through said outlet.

13. A hydraulic device according to claim 12, wherein a part of flank portions of said teeth is formed in an arc shape.

14. A hydraulic device according to claim 12, wherein a part of flank portions of said teeth is formed in a cycloid shape.

15. A hydraulic device according to claim 12, wherein said first and second rotor elements are displaced in a rotational direction by 30° relative to adjacent rotor elements.

16. A hydraulic device according to claim 12, wherein said first and second rotor elements are displaced in a rotational direction by 40° relative to adjacent rotor elements.

17. A hydraulic device according to claim 12, wherein said first and second shafts have flanges and nuts, respectively, said first rotor elements being sandwiched by said flange and nut to be fixed to said first shaft, and said second rotor elements being sandwiched by said flange and nut to be fixed to said second shaft.

18. A hydraulic device according to claim 12, wherein said housing has a longitudinal axis substantially parallel to a longitudinal axis of said first shaft and substantially parallel to a longitudinal axis of said second shaft, said inlet and outlet holes being defined at opposite longitudinal ends of said housing, the first and second rotor elements disposed near the outlet having a relatively small axial width.

19. A hydraulic device according to claim 18, wherein said first and second shafts are provided with helical gears, respectively, which are meshed to rotate said first and second shafts synchronously.

20. A hydraulic device according to claim 18, wherein said housing comprises a cylindrical casing having said rotor chamber and two openings, a front plate being fitted to one of said openings and having said inlet, a front casing covering said front plate to define an inlet chamber with said front plate and having an inlet port, a rear plate being fitted to the other one of said openings and having said outlet, a rear casing covering said rear plate to define an outlet chamber with said rear plate and having an outlet port.

21. A hydraulic device according to claim 12, wherein said first and second shafts have keys extending along the axis of said shafts, respectively, to fix said first and second rotor elements to said first and second shafts.

22. A hydraulic device according to claim 21, wherein said first and second rotor elements are provided with center holes for inserting said first and second shafts therein, each of said center holes having two notches 150° apart, said first and second rotor elements being displaced in a predetermined rotational direction so that one notch of every rotor element coincides with the notch of an adjacent rotor element.

* * * * *